United States Patent [19]

Ishida

[11] Patent Number: 4,616,610

[45] Date of Patent: Oct. 14, 1986

[54] LUBRICATING APPARATUS IN INTERNAL COMBUSTION ENGINE

[75] Inventor: Atsushi Ishida, Saitama, Japan

[73] Assignee: Honda Giken Kogyo Kabushiki Kaisha, Tokyo, Japan

[21] Appl. No.: 716,820

[22] Filed: Mar. 27, 1985

[30] Foreign Application Priority Data

Mar. 27, 1984 [JP] Japan ..... 59-43652[U]

[51] Int. Cl.[4] ..... F01M 1/00

[52] U.S. Cl. ..... 123/196 A; 123/196 R; 184/6.5

[58] Field of Search ..... 123/196 R, 196 A; 184/6.8, 6.5, 6.6, 6.7, 6.9, 6.18, 6.28

[56] References Cited

U.S. PATENT DOCUMENTS

| | | | |
|---|---|---|---|
| 1,992,339 | 2/1935 | Winslow | 184/6.8 |
| 3,504,769 | 4/1970 | Mettig | 123/196 R |
| 3,685,617 | 8/1972 | Gardner | 184/6.28 |
| 3,961,614 | 6/1976 | Rameau | 184/6.28 |
| 4,356,889 | 11/1982 | Teeter | 184/6.28 |
| 4,446,828 | 5/1984 | Bauder et al. | 123/196 R |
| 4,475,488 | 10/1984 | Odashima | 184/6.18 |

FOREIGN PATENT DOCUMENTS

| | | | |
|---|---|---|---|
| 2130653 | 6/1984 | United Kingdom | 184/1.5 |

*Primary Examiner*—E. Rollins Cross

*Attorney, Agent, or Firm*—Lyon & Lyon

[57] ABSTRACT

A lubricating apparatus in an internal combustion engine of the horizontal type in which a main oil gallery for feeding oil to engine portions to be lubricated is provided substantially parallel to the engine crank shaft in the bearing cap secured to engine block for rotatably supporting the crank shaft, and an oil filter is provided on the bearing cap at a central portion in the direction of the crank shaft. The oil pump is provided on one end of the crank shaft and oil passages are formed in the bearing cap for conducting the oil from the oil pump to the oil filter and then from the oil filter to the central portion of said main gallery.

7 Claims, 3 Drawing Figures

LUBRICATING APPARATUS IN INTERNAL COMBUSTION ENGINE

The present invention relates to a lubricating apparatus in a horizontal type internal combustion engine.

In internal combustion engines where lubricating oil is forcibly fed to the portions of the engine to be lubricated, the pressurized oil discharged from an oil pump is passed through an oil filter and thereafter fed under pressure to a main gallery formed in the engine body, from which oil is fed through passages to the portions to be lubricated. It is desirable for the lubricating oil from the oil filter to be fed under pressure to the main gallery with as small a resistance as possible to improve the distribution from the main gallery to the engine portions to be lubricated. However, an oil filter is relatively bulky and subjected to limitation in mounting position thereof on the engine body, and therefore there have been undesirable distances from the oil filter to the main gallery whereby deviations occur in distribution of the oil to the engine portions to be lubricated.

In view of the foregoing, it is an object of the present invention to provide a lubricating apparatus in an internal combustion engine which is simple in construction, while overcoming the undesirable characteristics of prior systems.

In accordance with the present invention, to achieve the above-described object, there is provided an arrangement wherein a cylinder block, a cylinder head and a crank case which constitute an engine body, are substantially horizontally disposed, whereby a main gallery for feeding oil to portions to be lubricated of the engine body is provided substantially parallel to a crank shaft on a bearing cap secured to said crank case, which bearing cap and crank case rotatably support the crank shaft, an oil filter is provided in a central location in the direction of the crank shaft on the outer end of the bearing cap, and the oil filter has an inlet placed in communication with an oil pump and an outlet placed in communication with the central portion of said main gallery.

One embodiment of the present invention will be described hereinafter with reference to the drawings, in which.

Figure 1:
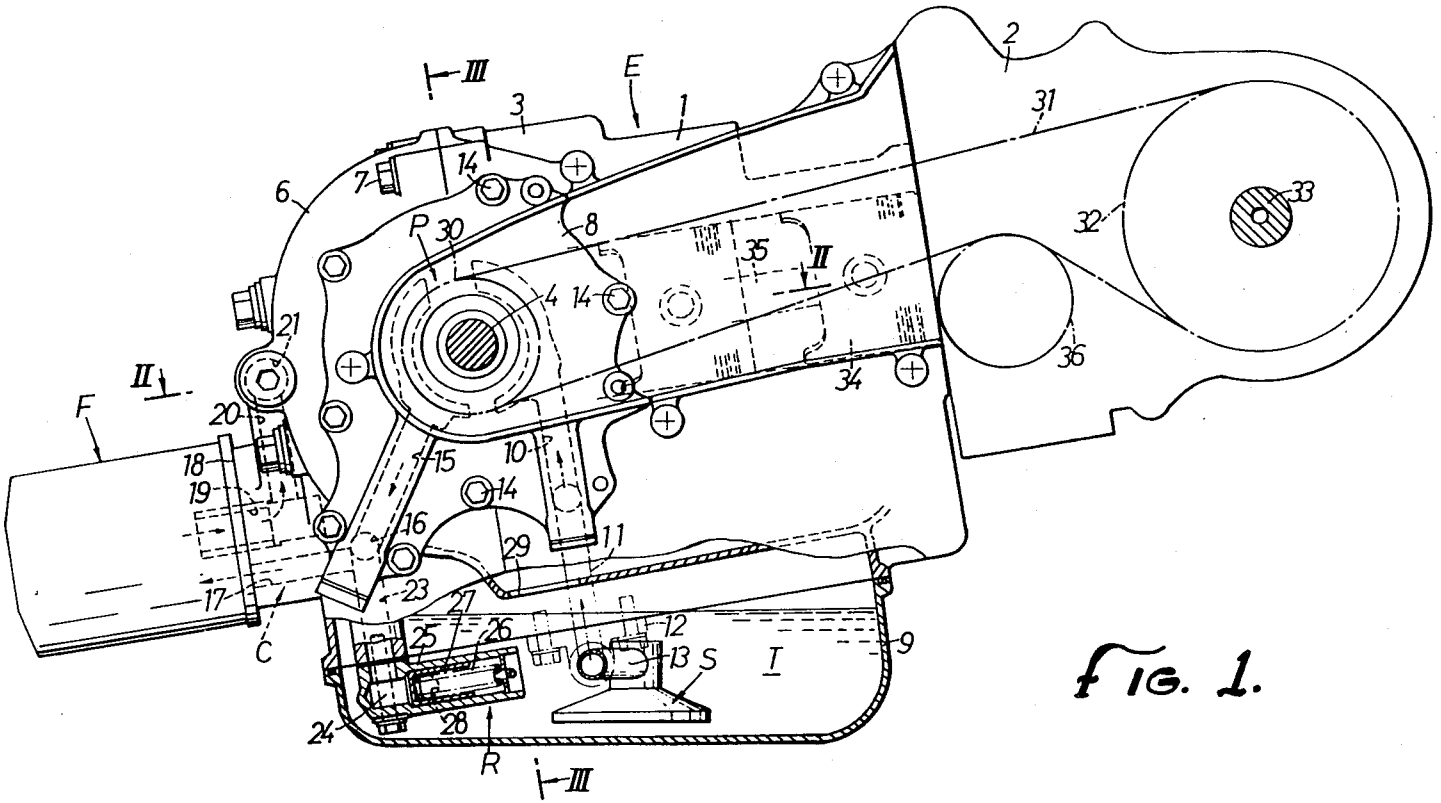
FIG. 1 is a longitudinal sectional elevation view of the internal combustion engine incorporating the lubricating apparatus of this invention.
Figure 2:
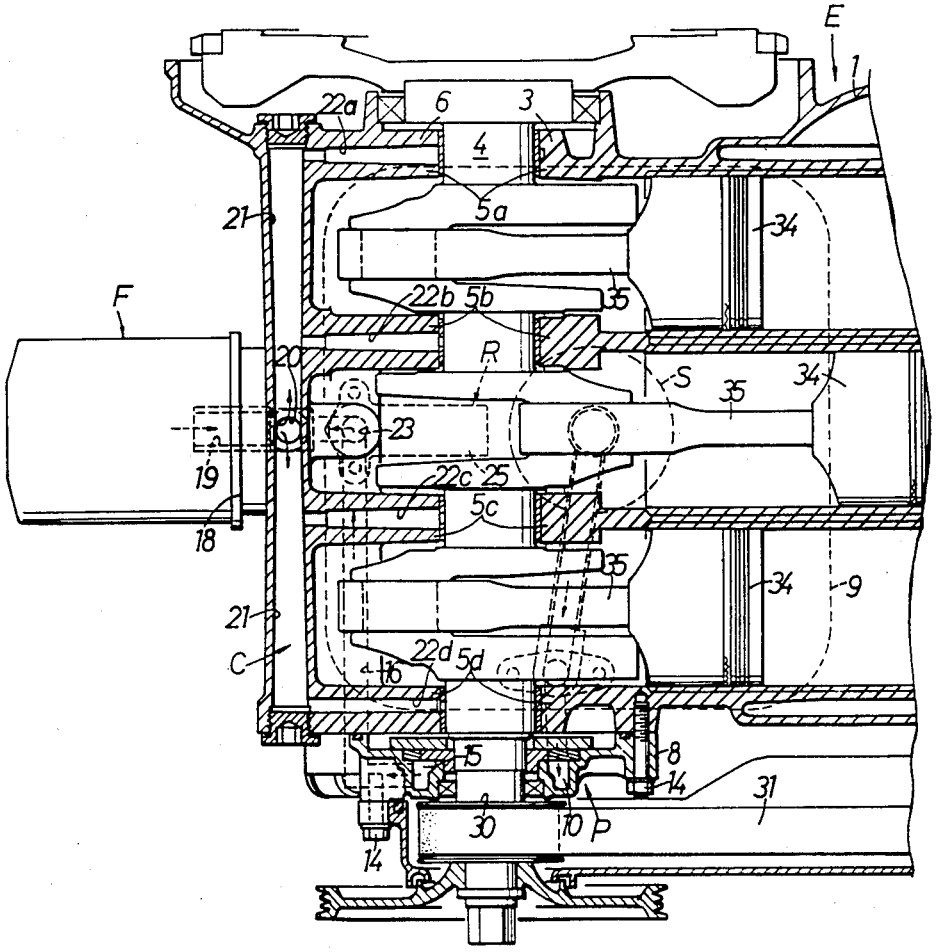
FIG. 2 is a sectional plan view of the engine taken substantially on the line II—II of FIG. 1.

Referring to FIGS. 1 and 2, the engine body E is a horizontal type 3-cylinder internal combustion engine comprising a cylinder block 1 and a crank case 3, which are integrally formed, and a cylinder head 2, which block, case and head are substantially horizontally disposed. A bearing cap 6 is secured to the crank case 3, and a substantially horizontal crank shaft 4 is rotatably supported by bearings $5_a$–$5_d$ formed between the bearing cap 6 and the crank case 3.

Figure 3:
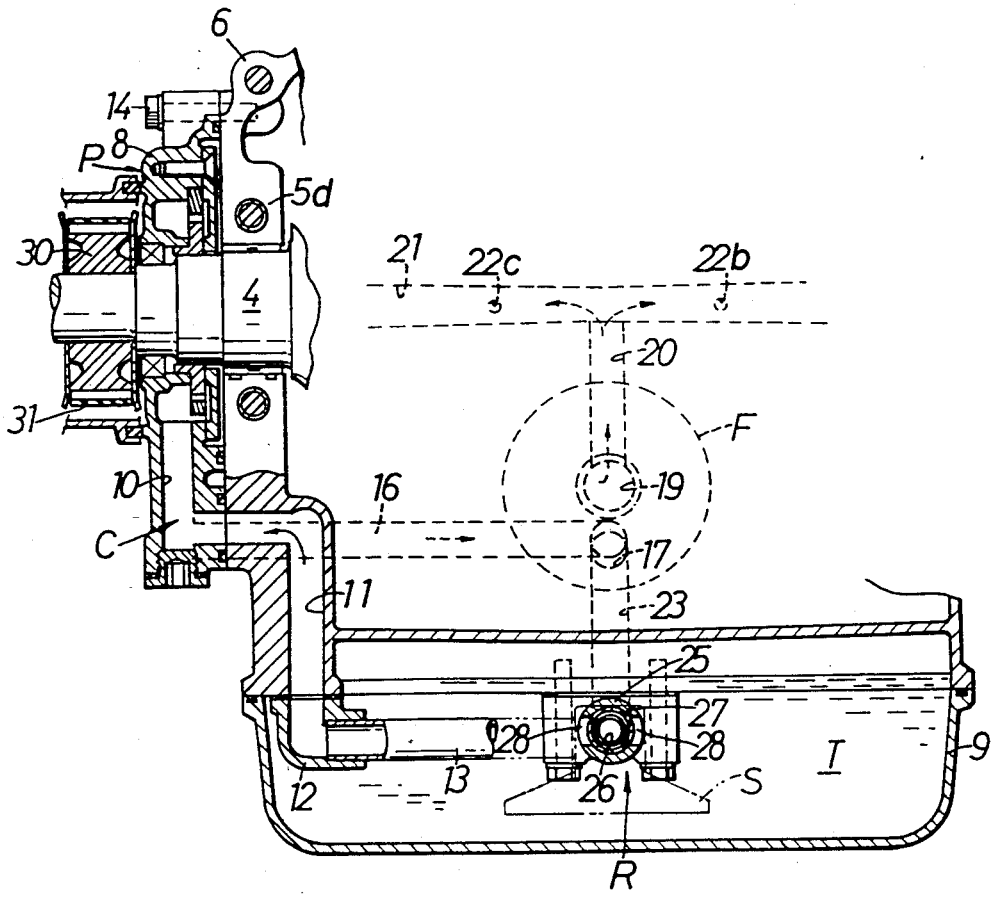
FIG. 3 is a sectional elevation view taken substantially on the line III—III of FIG. 1.

As shown in FIGS. 2 and 3, a casing 8 of a lubricating oil pump P is secured by bolts 14 to one side of the crank case 3 and bearing cap 6, the oil pump P being directly connected to the projected end of the crank shaft 4. Also, as shown in FIGS. 1 and 3, an oil pan 9 is fixed directly below crank case 3 and the bearing cap 6, and an oil returning portion 29 is open in the lower wall of the crank case 3 to drain into the oil pan 9, the interior of which forms an oil reservoir T for the lubricating oil. A lubricating oil circuit C is formed wherein pressurized lubricating oil from the oil pump P passes through the lubricating oil circuit C to engine portions to be lubricated within the engine body E, after which the oil returns to the oil reservoir T.

A suction port 10 of the oil pump P communicates with a suction passage 11 formed in the crank case 3 which in turn communicates with a suction pipe 13 through a connecting elbow 12 secured to the crank case 3. The suction pipe 13 has the other end connected to an oil strainer S immersed in the oil reservoir T. A discharge port 15 from the oil pump P communicates with a lateral discharge passage 16 formed in the bearing cap 6. This discharge passage 16 extends to the central portion of the bearing cap 6 and has the other end connected to a passage 17 extending laterally out the side of bearing cap 6 at about the longitudinal middle of the engine. The oil filter F is threadedly fixed to a mounting surface 18 formed in the outer surface in the central portion in the direction of the crank shaft 4 of the bearing cap 6 at the location of passage 17 for receiving pressurized oil from the pump. An outlet 19 from the oil filter F is in communication with an oil inlet passage 20 at the central portion lengthwise of the bearing cap 6. The oil inlet 20 is in communication with the central portion of a main gallery 21 formed in the bearing cap 6 substantially parallel to the crank shaft 4. This main gallery 21 is in communication with branch oil passages $22_a$–$22_d$ formed in the bearing support ribs of the bearing cap 6 and are open to the bearing surfaces of the crank shaft 4.

A bypass oil passage 23 is branched from a middle portion of the oil pump discharge passage 16. The bypass oil passage 23 extends downwardly towards the oil pan 9 and an open lower end thereof is connected to an inlet 24 of an oil regulator R. The oil regulator R has its casing 25 secured to the lower surface of the crank case 3 and is accommodated within the oil pan 9 with an outlet 28 thereof open into the oil reservoir T. The construction of the oil regulator R is well known, in which a valve body 27 urged in a one direction by means of a spring 26 is slidably accommodated within the hollow cylindrical casing 25 and the valve body 27 normally closes the outlet 28. When the oil pressure within the bypass oil passage 23 exceeds a predetermined value, said oil pressure causes the valve body 27 to be moved back against the spring force of the spring 26 to open the outlet 28, return a part of the oil within the bypass oil passage 23 into the oil reservoir T through the outlet 28, and reduce the pressure within the bypass oil passage 23 and passages 16 and 17 below a predetermined level.

A timing drive pulley 30 is secured, adjacent to the oil pump P, to one side of the crank case 3 and bearing cap 6, said pulley 30 being associated with a timing driven pulley 32 secured to one end of a rotatably valve cam shaft 33 through a timing belt 31. The remaining components of the engine that is illustrated are conventional and include the pistons 34, connecting rods 35, and a timing belt tension pulley 36.

When the crank shaft 4 is rotated during operation of the engine, the oil pump P directly connected thereto is driven. The lubricating oil within the oil pan 9 is suctioned into the oil pump P from the oil strainer S through the suction pipe 13, elbow 12 and suction passage 11. Pressurized oil from the oil pump P passes through the discharge passage 16 and is filtered by the oil filter P, after which the oil flows into the central portion of the main gallery 21, from which it lubricates bearing surfaces of the crank shaft 4 and other portions (not shown) to be lubricated in the engine body. After such lubrication the oil passes through the oil return portion 29 into the oil reservoir T.

When the oil pressure within the lubricating oil circuit C rises above a predetermined level for any reason, the oil pressure acts on the regulator R connected to the bypass oil passage 23 to actuate the oil pressure regulator R as mentioned above to open the outlet 28 to recirculate a part of oil within the bypass oil passage 23 to the oil reservoir T. When the oil pressure within the lubricating oil circuit C again drops below the predetermined level, the oil regulator R becomes inoperative and the outlet 28 thereof is closed by the valve body 27.

Since the oil regulator R is accommodated within the oil reservoir T and the outlet 28 thereof is open below the normal oil level within the oil reservoir T, air bubbles do not form in the oil regulator R and oil discharged from the oil regulator R directly flows into the oil reservoir T without being scattered in spaces within the crank case 3. Also, since the oil regulator R is positioned a substantial distance from the oil pump P it is less subject to pump pulsation.

The pressurized oil from the oil pump P flows into the central portion of the main gallery 21 passing through the oil inlet 20 and thence is branched to left and right to be distributed to a plurality of branched oil passages $22_1$–$22_4$ and therefore, the lubricating oil is supplied uniformly to left and right from a longitudinal center axis of the engine body, thus providing a good distributiveness to the plurality of portions to be lubricated.

As described above, in accordance with the present invention, there is provided a horizontal type internal combustion engine in which a main gallery for feeding oil to portions to be lubricated of the engine body is provided, substantially parallel to the crank shaft and in the crank shaft bearing cap, with an oil filter provided on the bearing cap in the central portion in the direction of the crank shaft, and with the inlet of the oil filter in communication with the oil pump and the outlet thereof in communication with the central portion of the main gallery. Thus, the outlet from the oil filter and the inlet of the main gallery may be positioned as close as possible to reduce a few resistance of oil, the distribution of the lubricating oil supplied to the plurality of engine portions to be lubricated from the main gallery is extremely enhanced, and as a whole the lubricating efficiency is considerably increased.

The invention claimed:

1. A lubricating apparatus in an internal combustion engine of the horizontal type having a cylinder block, comprising a crank shaft bearing cap mounted on the cylinder block, a main gallery provided in the bearing cap and extending substantially parallel to the crank shaft, an oil filter mounted on said bearing cap at substantially midlength of the main gallery, said oil filter having an inlet in communication with an oil pump and an outlet in communication with the main gallery at substantially its midlength.

2. The lubricating apparatus of claim 1 wherein a pressure regulator means is connected to said oil filter inlet for preventing the oil pressure to said oil filter from exceeding a predetermined level.

3. The lubricating apparatus of claim 2 wherein said pressure regulator means is positioned in a reservoir for the oil and below the normal oil level.

4. The lubricating apparatus of claim 1 wherein said oil pump is provided at one end of the crank shaft and a said passage is formed in the bearing cap extending to the oil filter inlet.

5. A lubricating apparatus for an internal combustion engine comprising an engine block, a crank case portion of the engine block having a bearing cap secured thereto and covering the open end of said crank case portion and rotatably supporting a crank shaft by bearings formed between the bearing cap and crank case, an oil pump connected to one end of the crank shaft, an oil filter mounted on the bearing cap, a first oil passage formed in the bearing cap connecting between said oil pump and the inlet of the oil filter, and a second oil passage formed in the bearing cap connecting between the outlet of said oil filter and the crank shaft bearings.

6. A lubricating system for a horizontal, multiple cylinder internal combustion engine comprising a cylinder block, a crankshaft, crankshaft bearings, a bearing cap means for supporting the crankshaft, an oil filter positioned on the bearing cap, an oil pump, and oil passages in the bearing cap for supplying oil from the pump to the filter and from the filter to a gallery in the bearing cap and from the gallery to the crankshaft bearings.

7. The system of claim 6 wherein the passage in the bearing cap from the filter to the gallery is positioned at the midlength of the gallery.

* * * * *